US009450342B2

(12) United States Patent
Wu et al.

(10) Patent No.: US 9,450,342 B2
(45) Date of Patent: Sep. 20, 2016

(54) PLUG CONNECTOR ASSEMBLY HAVING IMPROVED ANTI-EMI PERFORMANCE

(71) Applicant: FOXCONN INTERCONNECT TECHNOLOGY LIMITED, Grand Cayman (KY)

(72) Inventors: Jerry Wu, Irvine, CA (US); Jun Chen, Kunshan (CN); Fan-Bo Meng, Kunshan (CN)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 14/678,503

(22) Filed: Apr. 3, 2015

(65) Prior Publication Data

US 2015/0288107 A1 Oct. 8, 2015

(30) Foreign Application Priority Data

Apr. 4, 2014 (CN) ..... 2014 1 0134243
Apr. 4, 2014 (CN) ..... 2014 1 0134244

(51) Int. Cl.
*H01R 13/6593* (2011.01)
*H01R 24/60* (2011.01)

(52) U.S. Cl.
CPC ..... *H01R 13/6593* (2013.01); *H01R 24/60* (2013.01)

(58) Field of Classification Search
CPC ..... H01R 13/6593; H01R 13/6592; H01R 13/6581
See application file for complete search history.

(56) References Cited

U.S. PATENT DOCUMENTS

| | | | | |
|---|---|---|---|---|
| 8,011,968 | B2 | 9/2011 | Lai et al. | |
| 8,708,734 | B2 | 4/2014 | Su et al. | |
| 8,821,181 | B1 | 9/2014 | Lam et al. | |
| 8,870,598 | B2 | 10/2014 | Qi et al. | |
| 8,882,529 | B2 | 11/2014 | Weber et al. | |
| 2008/0003881 | A1* | 1/2008 | Wu | H01R 13/5808 439/607.41 |
| 2012/0028496 | A1* | 2/2012 | Su | H01R 13/6581 439/449 |
| 2012/0045935 | A1* | 2/2012 | Zhang | H01R 12/724 439/607.08 |
| 2013/0189872 | A1 | 7/2013 | Siahaan et al. | |
| 2013/0323970 | A1* | 12/2013 | Wang | H01R 13/6471 439/607.08 |
| 2014/0073185 | A1 | 3/2014 | Siahaan et al. | |
| 2015/0244118 | A1* | 8/2015 | Lin | H01R 24/60 439/357 |

* cited by examiner

*Primary Examiner* — Gary Paumen
(74) *Attorney, Agent, or Firm* — Ming Chieh Chang; Wei Te Chung

(57) ABSTRACT

An plug connector assembly (1) includes a mating member (10) including a front mating end (101) and a rear mating end (102), a cable (30) electrically connected with the mating member, a first shell (50) formed by sheet metal drawing and having a closed circumference, a second shell (60) formed by sheet metal drawing and having a closed circumference. The first shell includes a first front end (51) telescoped with the rear mating end, and a first rear end (52) opposite to the first front end. The second shell (60) includes a second front end (61) telescoped with the first rear end, and a second rear end (62) opposite to the second front end and telescoped on the cable.

18 Claims, 24 Drawing Sheets

PLUG CONNECTOR ASSEMBLY HAVING IMPROVED ANTI-EMI PERFORMANCE

BACKGROUND OF THE INVENTION

1. Field of the Invention

The present invention relates to an plug connector assembly connected with a cable, and more particularly to an anti-EMI (electromagnetic interference) structure of the plug connector assembly.

2. Description of Related Arts

U.S. Pat. No. 8,011,968, issued on Sep. 6, 2011 to Lai et al., discloses a plug connector assembly. The plug connector assembly comprises an insulative housing, a plurality of contacts mounted to the insulative housing, a cable electrically connected with the contacts, and a metal shell mounted on an outer side of the insulative housing and cable. The metal shell comprises an upper shell and a bottom shell latched with the upper shell along vertical direction. The bottom shell comprises a front portion having a closed circumference, and a rear portion having an open circumference. The upper shell comprises a body portion having an open circumference to be mated with the rear portion of the bottom shell, and a crimping portion extending rearwardly from the body portion for being crimped with the cable. There are a plurality of gaps formed between the front and rear portions of the bottom shell and the crimping and body portions of the upper shell, when the upper shell is mated with the bottom shell. Therefore. anti-EMI performance and strength of the metal shell are poor.

U.S. Pat. No. 8,708,734, issued on Apr. 29, 2014 to Su et al., discloses a plug connector assembly. The plug connector assembly comprises an insulative housing, a plurality of contacts mounted to the insulative housing, a printed circuit board assembled to rear ends of the contacts, a cable electrically connected with the contacts, a front metal shell mounted on an outer side of the insulative housing, a strain relief member, and a rear shell formed by metal or insulative material. The front metal shell comprises a front portion defining a pair of through holes, a middle portion smaller than the front portion, and a rear portion smaller than the middle portion. The strain relief member is molded on the rear portion of the front metal shell and the cable. The rear shell is telescoped on an outer side of the middle portion of the front metal shell.

An improved plug connector assembly is desired to offer advantages over the related art.

SUMMARY OF THE INVENTION

An object of the present invention is to provide a plug connector assembly without gaps between connecting portions of metal shells and having good anti-EMI performance.

To achieve the above-mentioned object, a plug connector assembly adapted for mating with a mating connector, comprising: a mating member comprising a front mating end for being inserted into the mating connector, and a rear mating end opposite to the front mating end; a cable electrically connected with the mating member; a first shell formed by sheet metal drawing, the first shell having a closed circumference, the first shell comprising a first front end telescoped with the rear mating end, and a first rear end opposite to the first front end; and a second shell formed by sheet metal drawing, the second shell having a closed circumference, the second shell comprising a second front end telescoped with the first rear end, and a second rear end opposite to the second front end and telescoped on the cable.

The present invention secondly provides a plug connector assembly adapted for mating with a mating connector, comprising: a mating member comprising a front mating end for being inserted into the mating connector, and a rear mating end opposite to the front mating end; a cable electrically connected with the mating member; a spacer comprising a first portion and a second portion disposed behind the first portion, the second portion having a diameter larger than a diameter of the first portion; a first shell having a closed circumference, the first shell comprising a first front end telescoped with the rear mating end, and a first rear end opposite to the first front end; and a second shell having a closed circumference, the second shell comprising a second front end telescoped with the first rear end, and a second rear end opposite to the second front end and telescoped on the cable; wherein the first rear end is telescoped on the first portion of the spacer, and the second front end is slid over the second and telescoped on an outer side of the first rear end.

According to the present invention, both of the first and the second shells have a closed circumference. Therefore, the plug connector assembly has good seal performance, improved anti-EMI, and improved structural strength.

DETAILED DESCRIPTION OF THE PREFERRED EMBODIMENT

Reference will now be made in detail to a preferred embodiment of the present invention.

Figure 1:
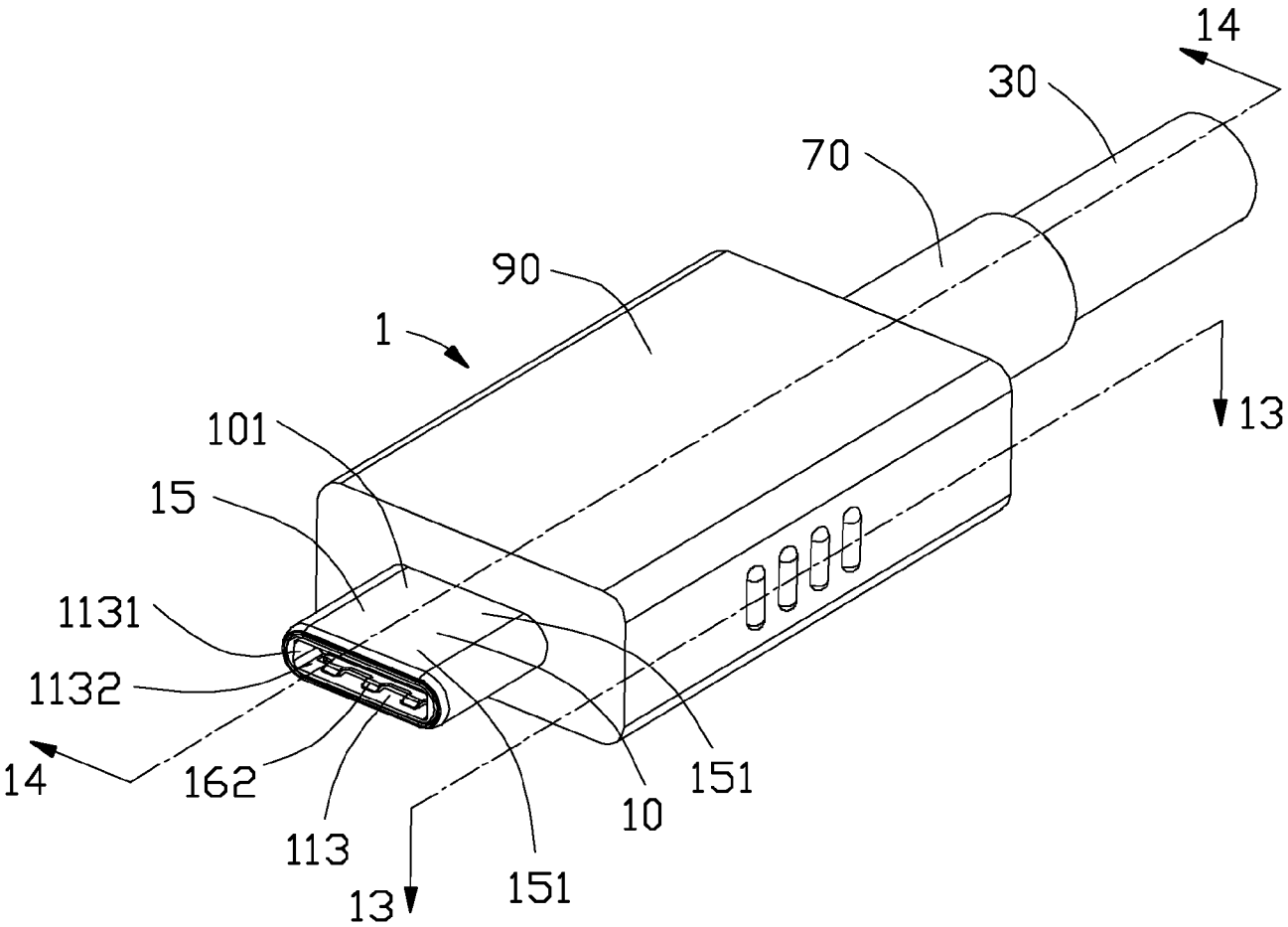
FIG. 1 is a perspective view of a plug connector assembly in accordance with a first embodiment of the present invention.
Figure 2:
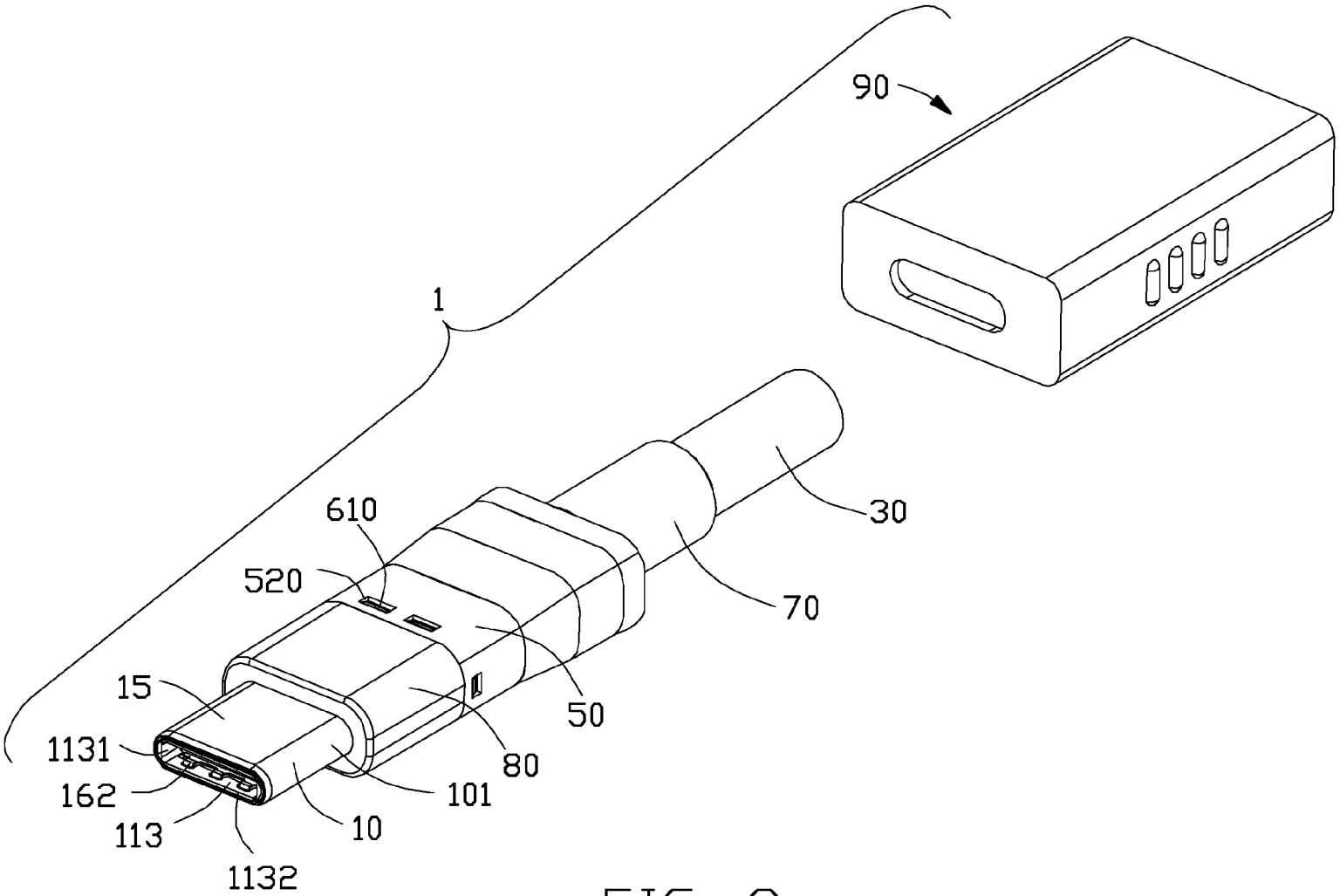
FIG. 2 is a partially exploded view of the plug connector assembly as shown in FIG. 1.
Figure 3:
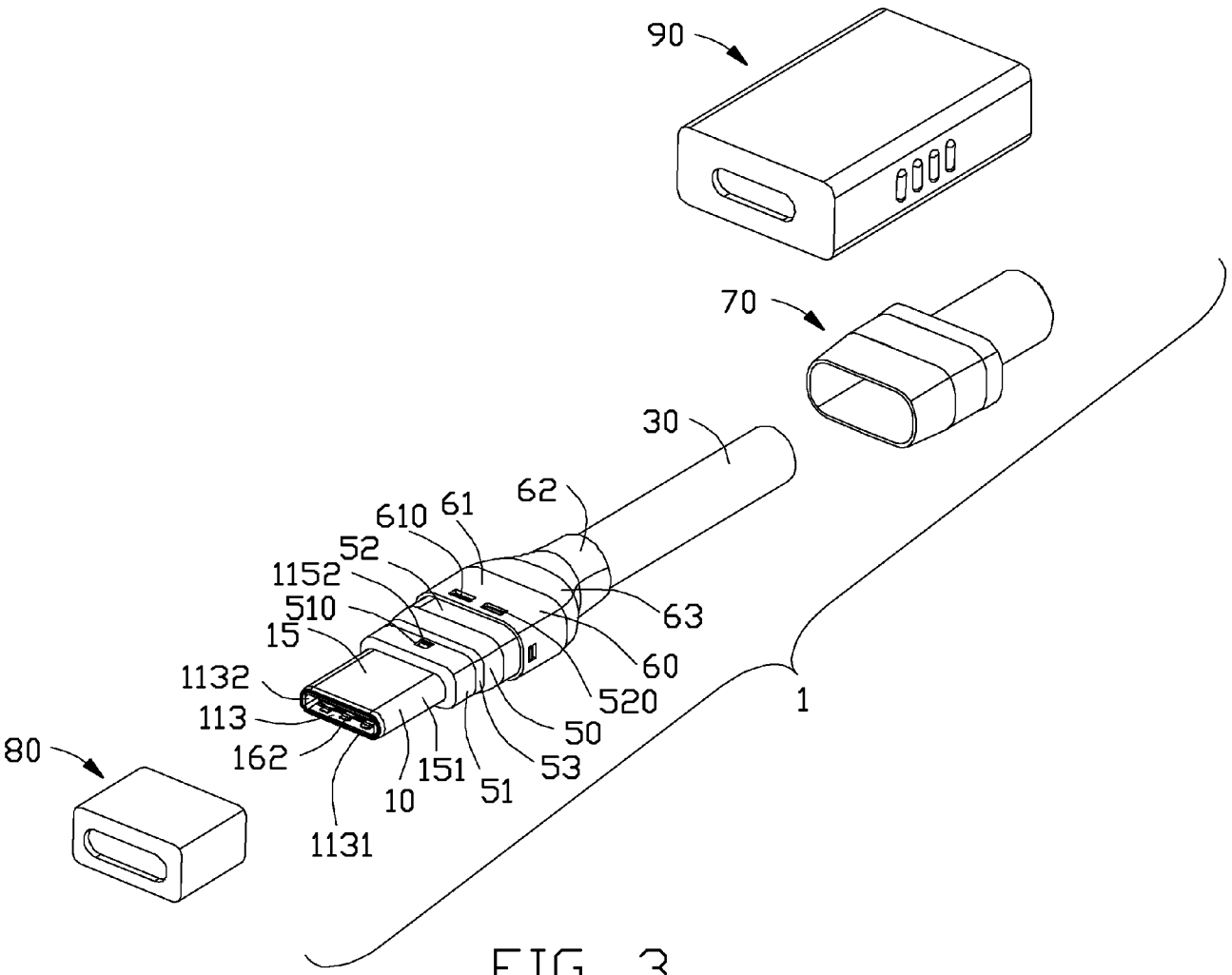
FIG. 3 is a further partially exploded view of the plug connector assembly as shown in FIG. 2.
Figure 4:
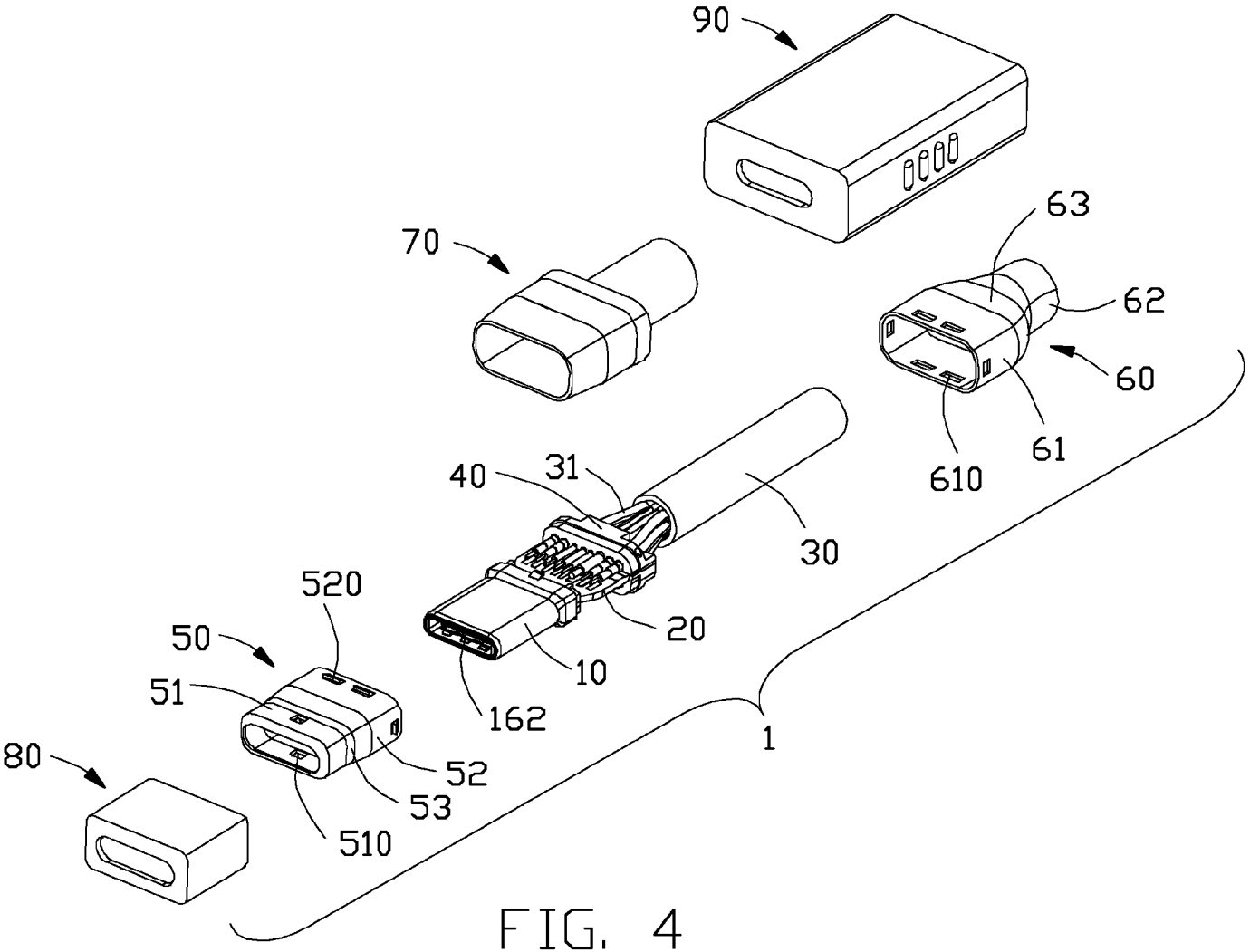
FIG. 4 is a further partially exploded view of the plug connector assembly as shown in FIG. 3.
Figure 5:
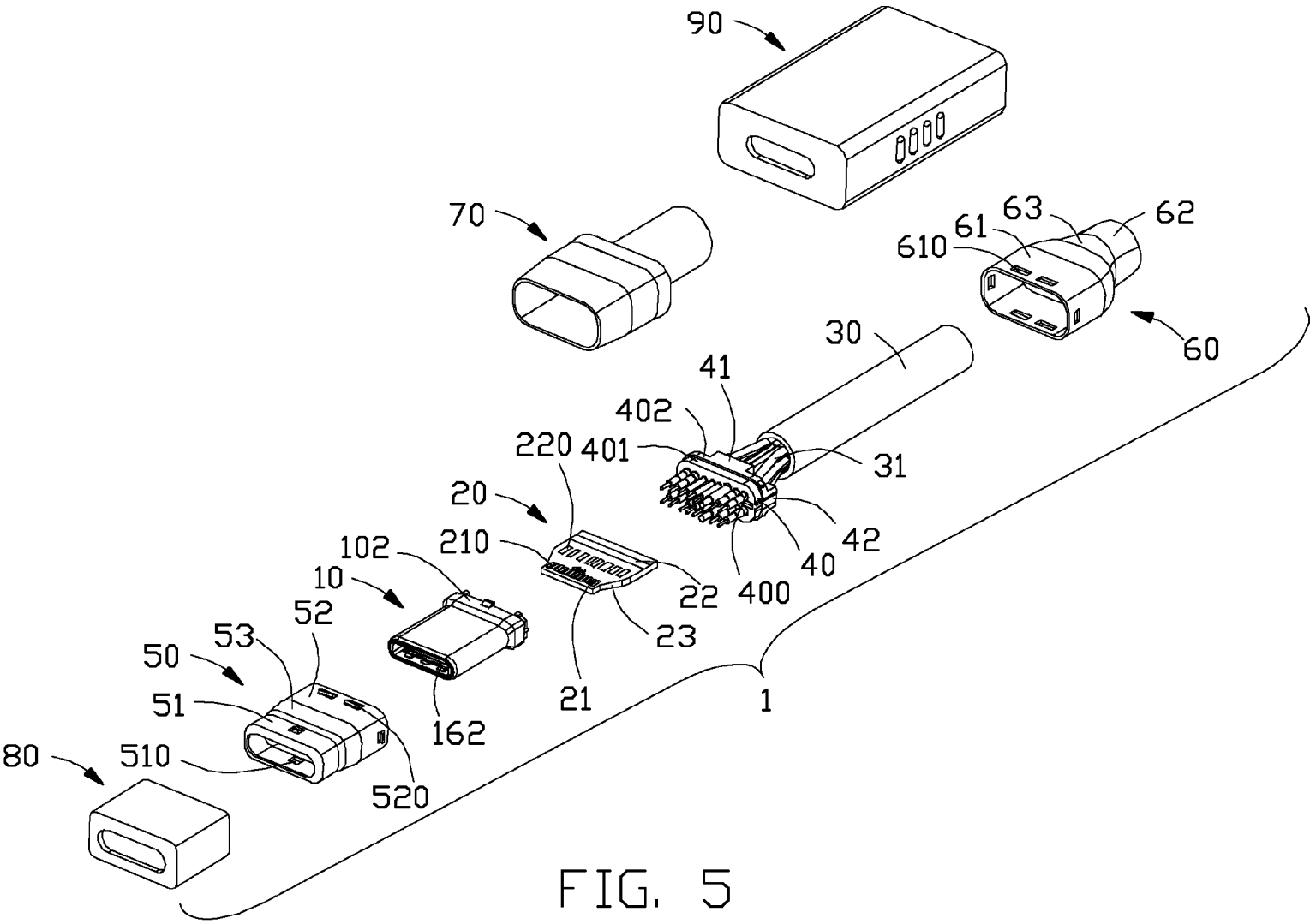
FIG. 5 is an exploded view of the plug connector assembly as shown in FIG. 1.
Figure 6:
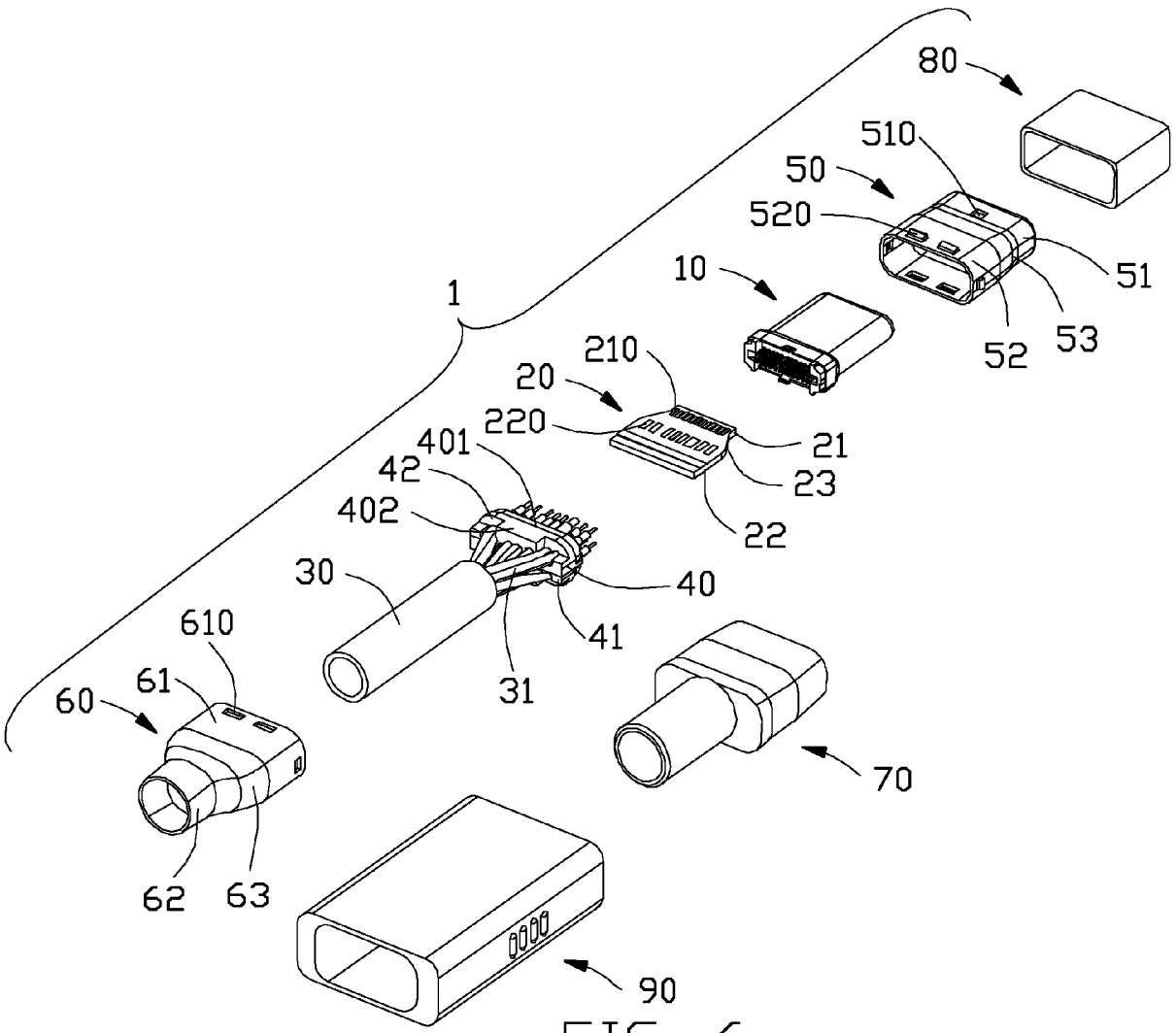
FIG. 6 is another exploded view of the plug connector assembly as shown in FIG. 5.
Figure 7:
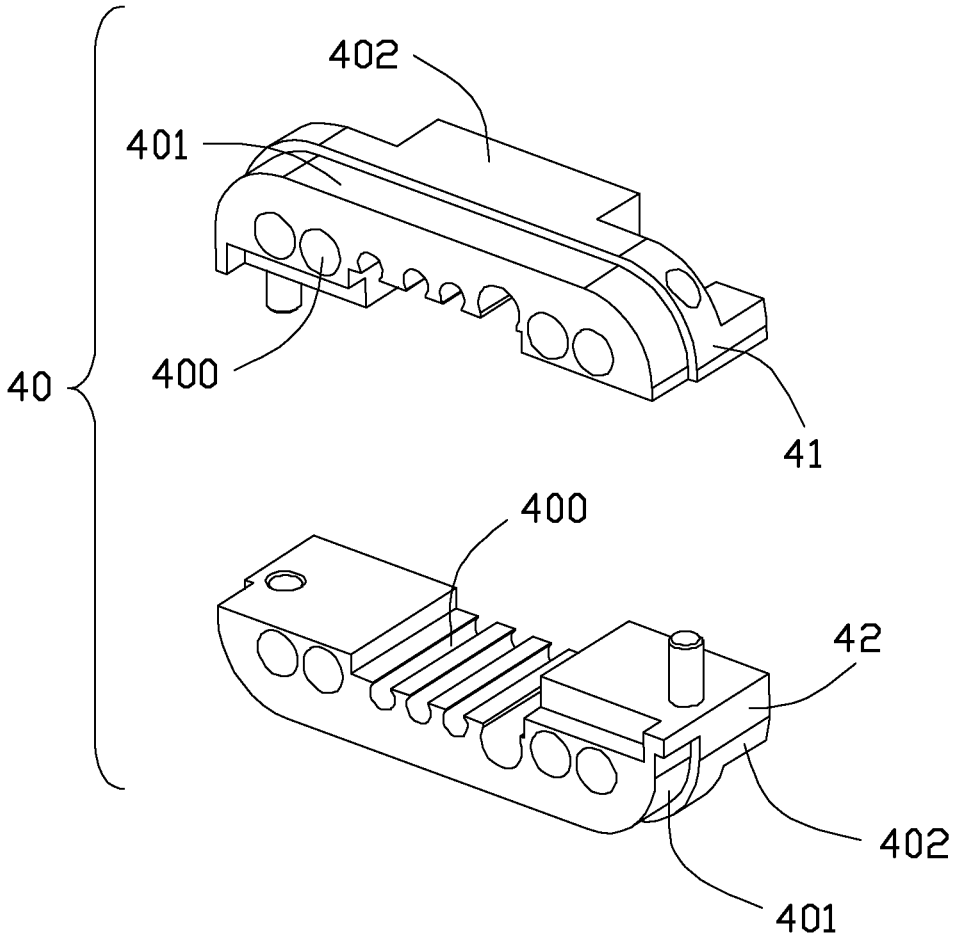
FIG. 7 is an exploded view of the insulative member of the plug connector assembly as shown in FIG. 1.
Figure 8:
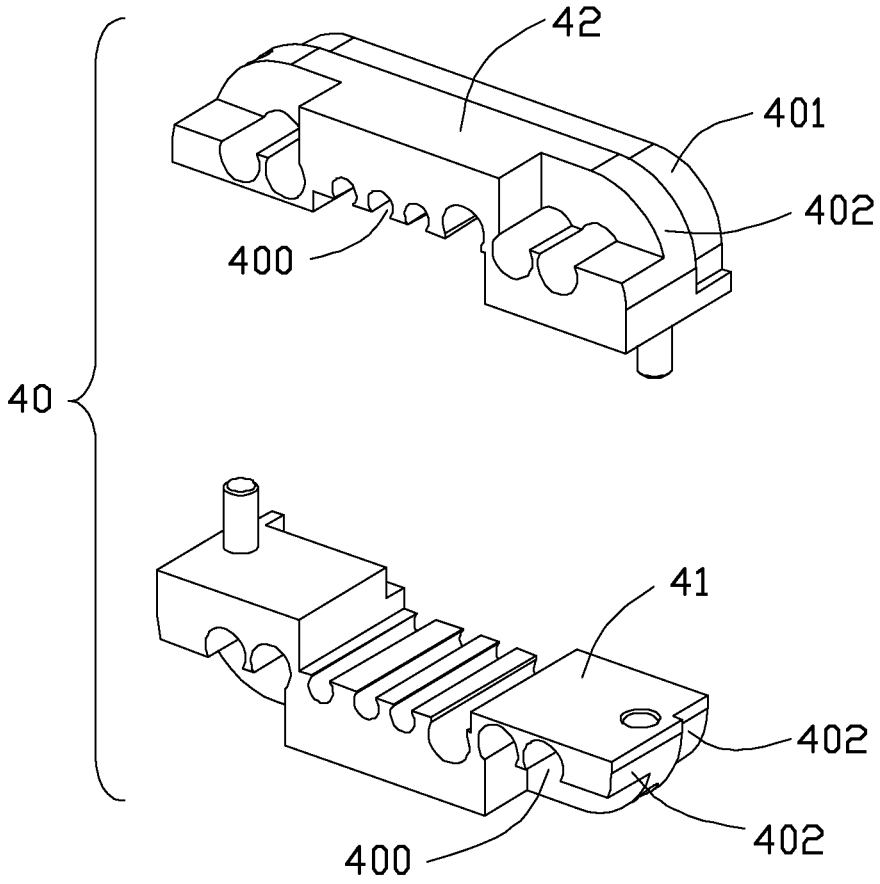
FIG. 8 is another exploded view of the insulative member as shown in FIG. 7.
Figure 9:
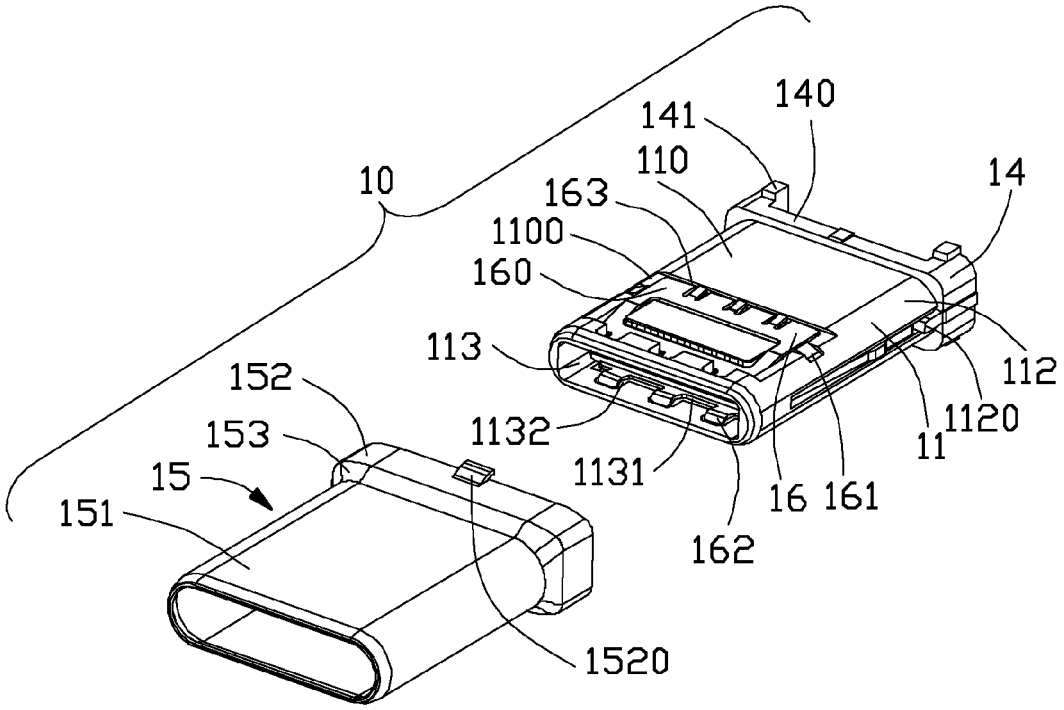
FIG. 9 is a partially exploded view of the mating member as shown in FIG. 1.
Figure 10:
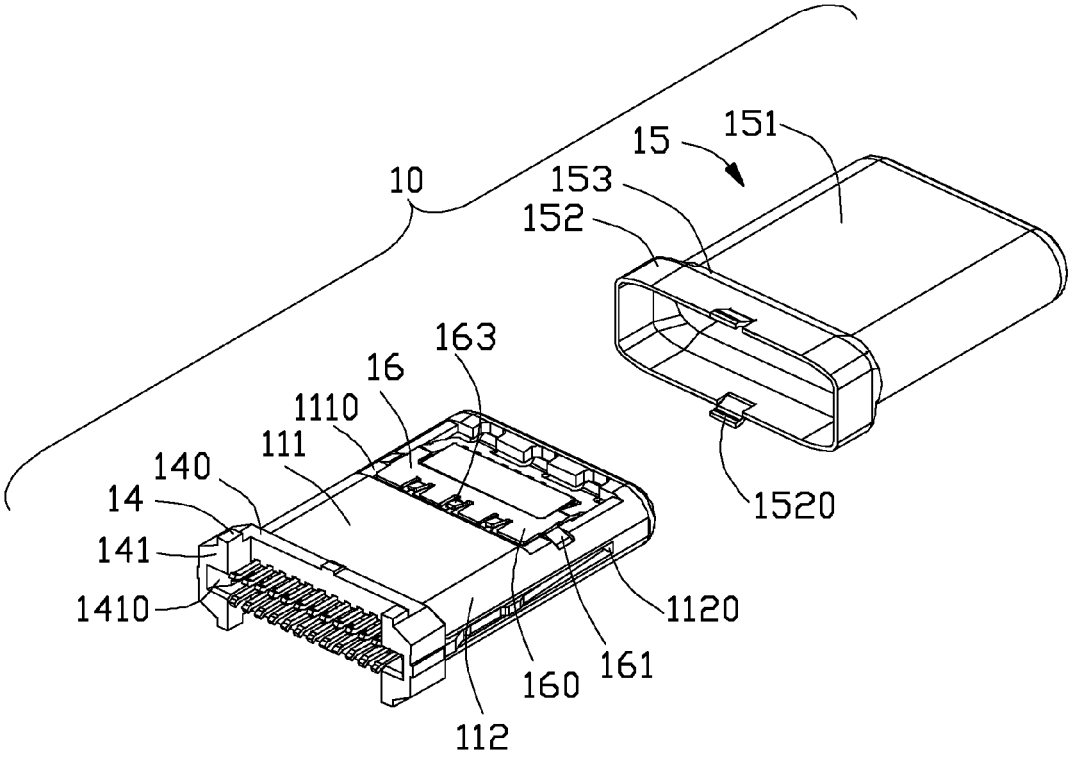
FIG. 10 is another partially exploded view of the mating member as shown in FIG. 9.
Figure 11:
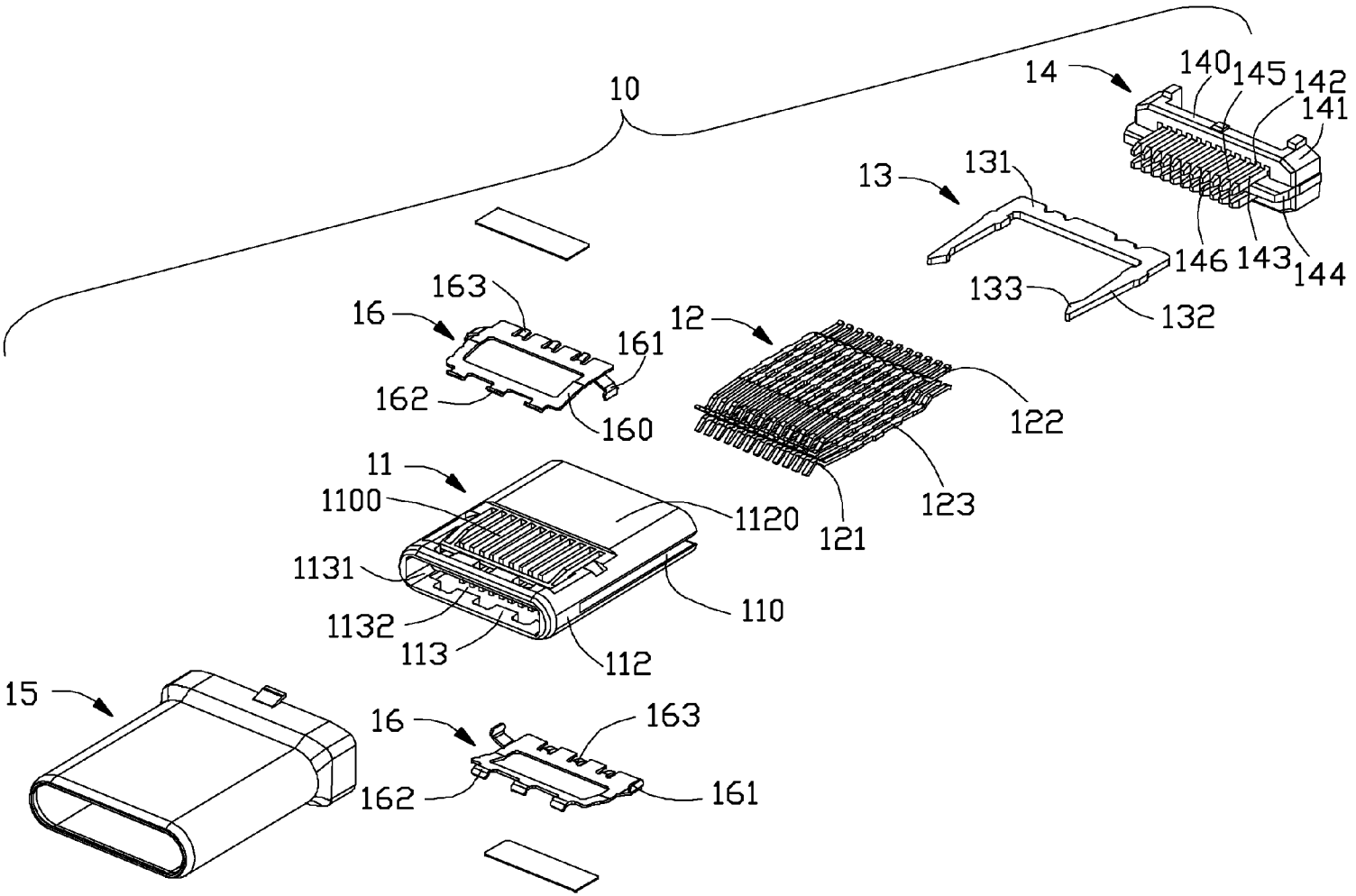
FIG. 11 is an exploded view of the mating member of the plug connector assembly as shown in FIG. 1.
Figure 12:
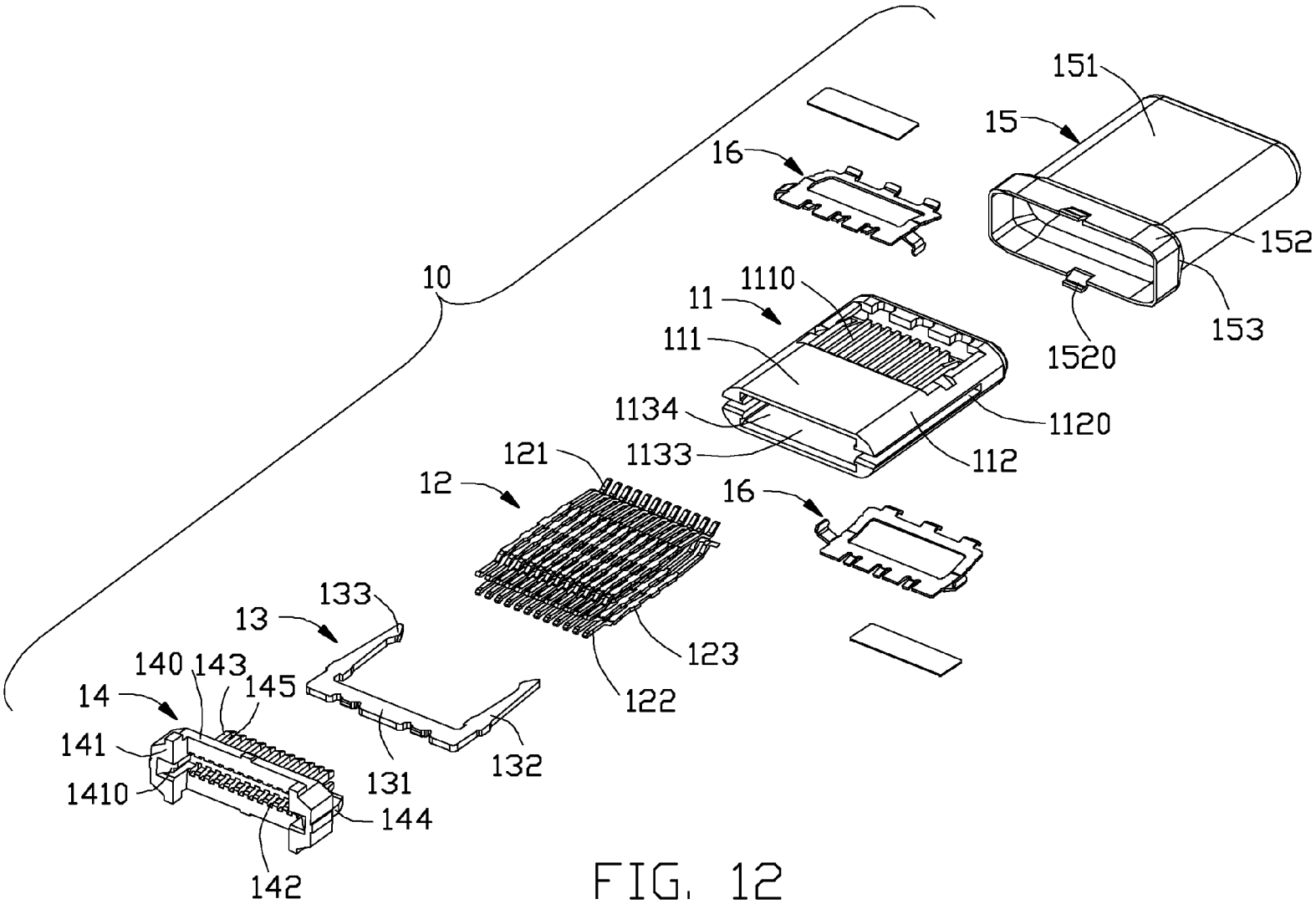
FIG. 12 is another exploded view of the mating member as shown in FIG. 11.
Figure 13:
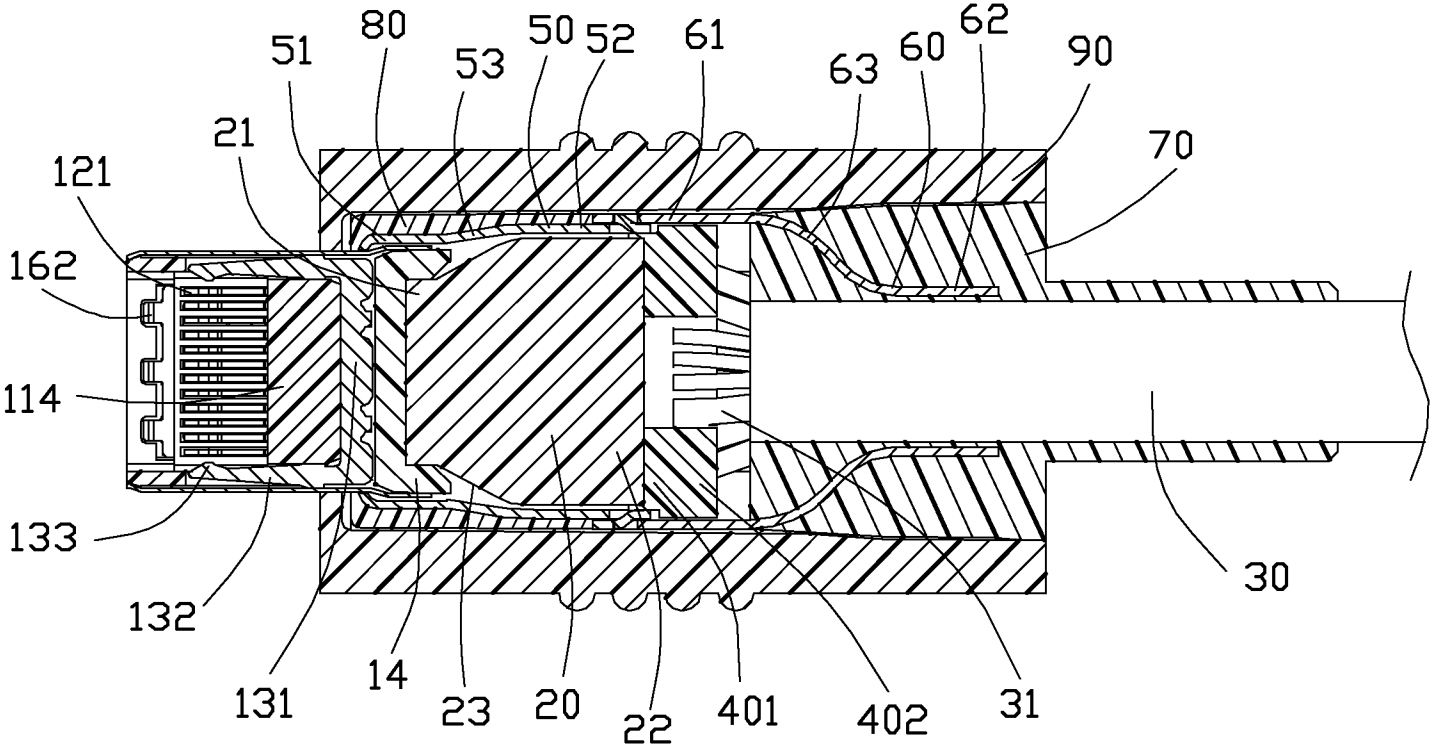
FIG. 13 is a cross-section view of the plug connector assembly taken along line XIII-XIII of FIG. 1.
Figure 14:
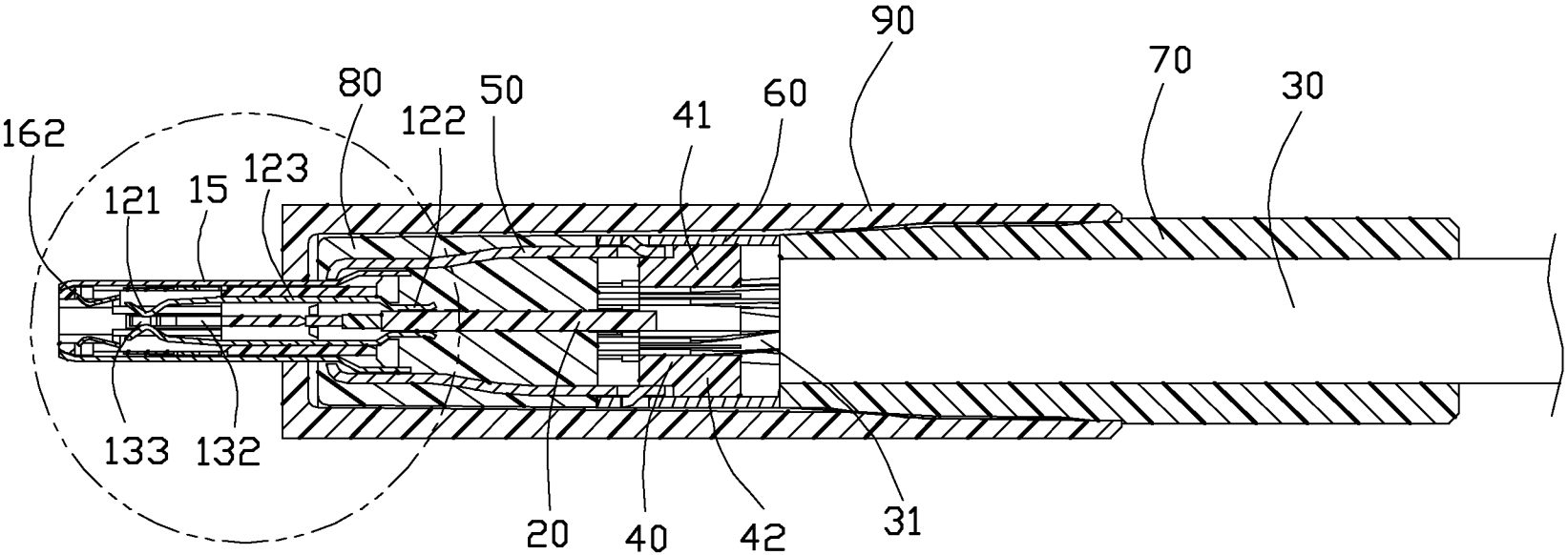
FIG. 14 is a cross-section view of the plug connector assembly taken along line XIV-XIV of FIG. 1.
Figure 15:
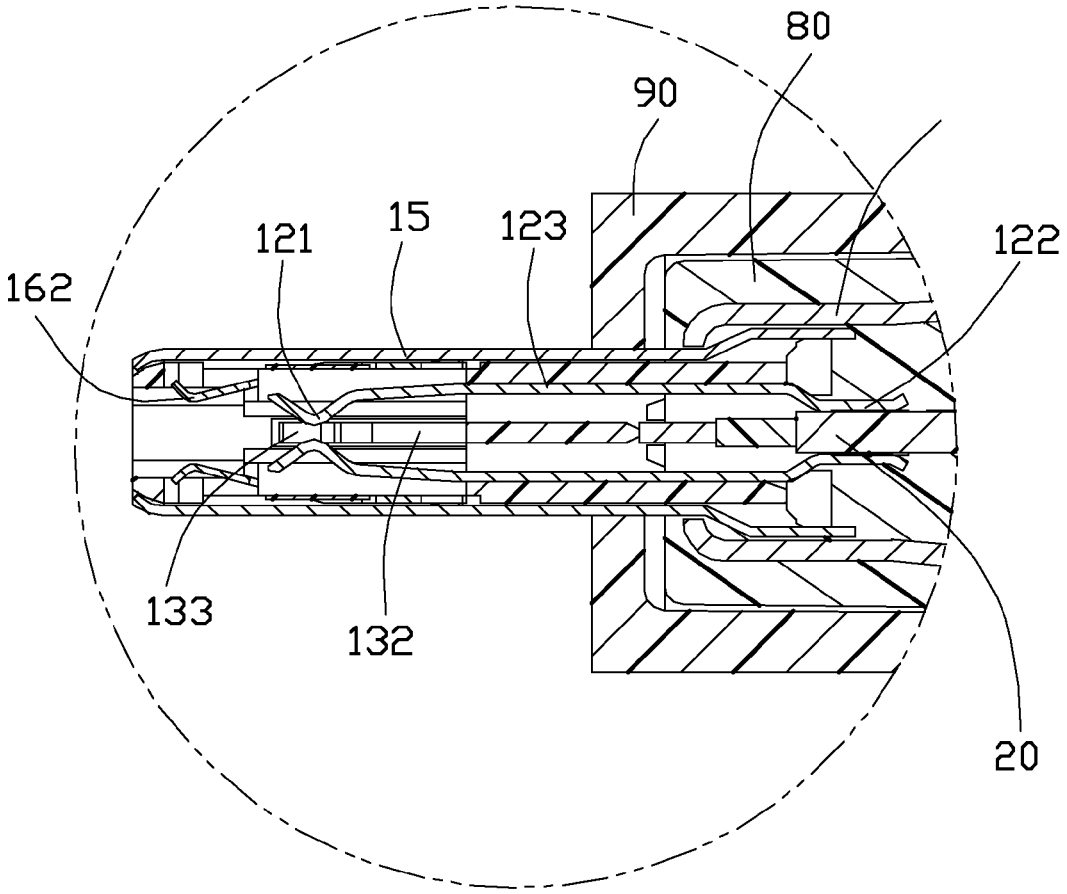
FIG. 15 is an enlarged view of circled portion as shown in FIG. 14.

Referring to FIGS. 1 to 15, an plug connector assembly 1 in accordance with a first embodiment of the present invention adapted for mating with a mating connector (Not shown), comprises a mating member 10, a printed circuit board 20 disposed behind and electrically connecting with the mating member 10, a cable 30 comprising a plurality of wires 31 and electrically connected with the printed circuit board 20, a spacer 40 for organizing the wires 31, a first shell 50 having a closed circumference, a second shell 60 having a closed circumference, a strength released member 70, an inner mold 80 molded on the first shell 50, and an outer mold 90. The plug connector assembly can be mated with the mating connected along two opposite directions.

The mating member 10 has a front mating end 101 for being inserted into the mating connector, and a rear mating end 102 opposite to the front mating end 101. The mating member 10 comprises insulative housing 11, a plurality of first contacts 12 arranged in two rows and spaced apart with each other in a vertical direction, a latch 13 disposed between the two rows of contacts 12 and for latching with the mating connector, an insulative member 14 disposed behind the insulative housing 11, a third shell 15 covering the insulative housing 11 and the insulative member 14, and a pair of grounding members 16 disposed on the insulative housing 11.

Referring to FIGS. 6 and 9-15, the insulative housing 11 comprises a top wall 110, a bottom wall 111 spaced apart from and parallel with the top wall, a pair of side walls connecting the top wall 110 and the bottom wall 111, a receiving room 113 surround by the top wall 110, the bottom wall 111 and the side walls 112, and a internal wall 114 divided the receiving room 113 into a front portion 1132 having a front opening 1131, and a rear portion 1134 having a rear opening 1133. The top wall 110 defines a top recess 1100 in communication with the front portion 1132 of the receiving room 113. The bottom wall 111 defines a bottom recess 1110 in communication with the front portion 1132 of the receiving room 113. Each of the side walls defines a side recess 1120 extending forwardly from a rear end of the insulative housing 11 but not through a front end of the insulative housing 11. The side recesses are in communication with the front portion 1132 and the rear portion 1134 of the receiving room 113.

Referring to FIGS. 11-15, each of the contacts 12 comprises front mating portion 121 extending forwardly into the front portion 1132 of the receiving room 113, a rear mating portion 122 extending rearwardly, and a mounting portion 123 fix on the insulative housing 11 and connected between the front mating portion 121 and the rear mating portion 122. The front mating portion 121 is used for being mated with the mating connector, and the second mating portion 122 is used for being mated with the printed circuit board 20. The front mating portions 121 of the two row contacts 12 are arranged face to face along vertical direction.

Referring to FIGS. 9-15, the latch 13 comprises a base portion 131 extending along a transverse direction, a pair of latch beam 132 respectively extending forwardly from two opposite ends of the base portion 131, a latch portion 133 extending from a front end of each latch beam 132 along a face to face direction. The latch 13 is mounted into the insulative housing 11 by the rear opening 1133 of the rear portion 1134 of the receiving room 113. The base portion 131 is forwardly against with the internal wall 114, and the latch beams 132 are received into the side recesses 1120, respectively. At least a portion of each of the latch portions 133 is projected into the front portion 1132 of the receiving room 113.

Referring to FIGS. 9-15, the insulative member 14 is cooperated with the insulative housing 11 to fix the latch 13. The insulative member 14 comprises an insulative base portion 140, a pair of extending portions 141 extending rearwardly from two opposite ends, two rows through holes 142 spaced apart from vertical direction and extending through the insulative base portion 140 along a front to rear direction, two rows of posts 143 spaced apart from vertical direction and extending forwardly, and a projected portion 144 extending forwardly and disposed between the two rows of the posts 143. A channel 145 is formed between the two adjacent posts 143 of each row and in communication with corresponding on of the through holes 142. Each of the extending portions 141 defines a mounting slot 1410 extending along a rear to front direction. The posts 143 extend forwardly beyond the projected portion 144. A receiving slot 146 is formed between the two rows of the posts 143. The insulative base portion 140 is thicker than the insulative housing 11. The insulative member 14 is mounted to the insulative housing 11 along a rear to front direction. The base portion 131 of the latch 13 is received into the receiving slot 146 of the insulative member 14, and the projected portion 144 is pressed against a rear side of the base portion 131. The rear mating portions 122 of the contacts 12 extend through the insulative member 140 by the channels 145, respectively.

Referring to FIGS. 1-15, the third shell 15 has a closed circumference that has a good seal performance, a good anti-EMI performance etc. The closed circumference of the third shell 15 could be formed by sheet metal drawing, bend metal piece, die casting, etc. The third shell 15 comprises a third front end 151 for being inserted into the mating connector, a third rear end 152 for being mated with the first shell 50, and a third transition portion 153 connected the third front end 151 and the third rear end 152. A diameter dimension of the third front end 151 is smaller than a diameter dimension of the third rear end 152. The third rear end 152 comprises a pair of latch tabs 1520 projected outwardly.

Referring to FIGS. 9-15, one of the grounding members 16 is received into the top recess 1110, and the other one is received into the bottom recess 1110. Each of the grounding members 16 comprises a flat body portion 160, a pair of mounting portions 161 extending from two opposite ends of the flat body portion 160 and toward the insulative housing 11 for being attached to the insulative housing 11, a plurality of front grounding tabs 162 extending forwardly from a front side of the flat body portion 160 and entered into the front portion 1132 of the receiving room 113, and a plurality of rear grounding tabs 163 extending rearwardly from a rear side of the flat body portion 160. The front grounding tabs 162 are used for mating with the mating connector. The rear grounding tabs 163 are used for mating with the third shell 15. The front grounding tabs 162 of the pair grounding members 16 are disposed face to face along vertical direction. A distance along a vertical direction between the front grounding tabs 162 of the pair grounding members 16 is greater than a distance along the vertical direction of the front mating portion 121 of the two rows of the contacts 12.

Referring to FIGS. 4-6 and 13-15, the printed circuit board 20 is disposed between the mating member 10 and the cable 30. The cable 30 is electrically connected with the contacts 12 by the printed circuit board 20. The printed circuit board 20 comprises a front portion 21, a rear portion 22, and a middle portion 23 connecting the front portion 21 and a rear portion 22. The front portion is smaller than the rear portion 22 along a transverse direction. The front portion 21 of the printed circuit board 20 is disposed between the rear mating portions 122 of the two rows of the contacts 12. The printed circuit board 20 comprises a plurality of front conductive pads 210 disposed on opposite side faces of the front portion 21 for electrically connecting with the rear mating portions 122 of the contacts 12, and a plurality of rear conductive pads 220 disposed on opposite side faces of the rear portion 22 for electrically connecting with the wires 31 of the cable 30. The printed circuit board 20 is mounted to the insulative member 14 by the front portion 21 along the mounting slots 1410.

Referring to FIGS. 4-6 and 13-15, the spacer 40 comprises a first portion 401 and a second portion 402 disposed behind the first portion 401, the second portion having a diameter larger than a diameter of the first portion. A gap between the first portion 401 and a second portion 402 is equal to or larger than a thick diameter of the circumference of the first shell 50. The spacer 40 comprises an upper half portion 41 and a bottom half portion 42 mounted with the upper half portion 41. Each of the upper and bottom half portions 41, 42 defines a plurality of though holes 400 extending therethrough, each of the wires 31 of cable 30 received in the through holes 400, respectively. The spacer 40 is forwardly pressed against a rear side of the printed circuit board 20. The wires 31 of the cable 30 is divided into two rows by the upper and bottom half portions 41, 42 that is facility to connect with the rear conductive pads 220 of the printed circuit board 20.

Referring to FIGS. 2-6 and 13-15, the first shell 50 has a closed circumference that has a good seal performance, a good anti-EMI performance etc. The closed circumference of the first shell 50 could be formed by sheet metal drawing, bend metal piece, die casting, etc. The first shell 50 comprises a first front end 51 telescoped with the rear mating end 102 of the mating member 10, a first rear end 52 opposite to the first front end 51, and a first transition portion 53 connecting with the first front end 51 and the first rear end 52. The first front end 51 is larger than the first rear end 52. The first front end 51 defines a pair of latch holes 510 latched with the latch tabs 1520 of the third shell 15, when the first shell 50 is telescoped on an outer side of the third rear end 152 of the third shell 15. The first front end 51 of the first shell 50 is interference fitted with the third rear end 152 of the third shell 15 that has a good seal performance and good anti-EMI performance. The first front end 51 of first shell 50 and the third rear end 152 of the third shell 15 are further connected by laser beam welded in some points or full circumference that has a good strength. The first rear end 52 comprises a plurality of latch tabs 520. The first rear end 52 is telescoped on an outer side of the first portion 401 of the spacer 40.

The second shell 60 has a closed circumference that has a good seal performance, a good anti-EMI performance etc. The closed circumference of the second shell 60 could be formed by sheet metal drawing, bend metal piece, die casting, etc. The second shell 60 comprises a second front shell 61 telescoped with the first rear end 52 of the first shell 50, a second rear end 62 telescoped and crimped with the cable 30, and a second transition portion 63 connecting with the second front end 61 and the second rear end 62. The second front end 61 is larger than a second rear end 62. The second front end 61 defines a plurality of latch holes 610. Firstly, the second shell 60 is telescoped on the cable 30. The second shell is moved forwardly and telescoped on an outer side of the second portion 402 of the spacer 40, after the wires 31 are soldered on the rear conductive pads 220. Then, the second shell are forwardly moved beyond the second portion 402 of the spacer 40 to telescope on an outer side of the first rear end 52 of the first shell 50 and the latch holes 610 be latched with the latch tabs 520 of the first shell 50 that has a good seal performance and good anti-EMI performance. The second front end 61 of second shell 60 and the first rear end 52 of the first shell 50 are further connected by laser beam welded in some points or full circumference that has a good strength.

The strength released member 70 is molded on the second shell 60 and the cable 30 to reduce the strength, when the cable 30 is bent. The inner mold 80 is molded on the first shell 50 and the third shell 15 to enhance the plug connector assembly 1, when a press is applied on. The outer mold 90 can be molded or mounted on the inner mold 80.

Figure 16:
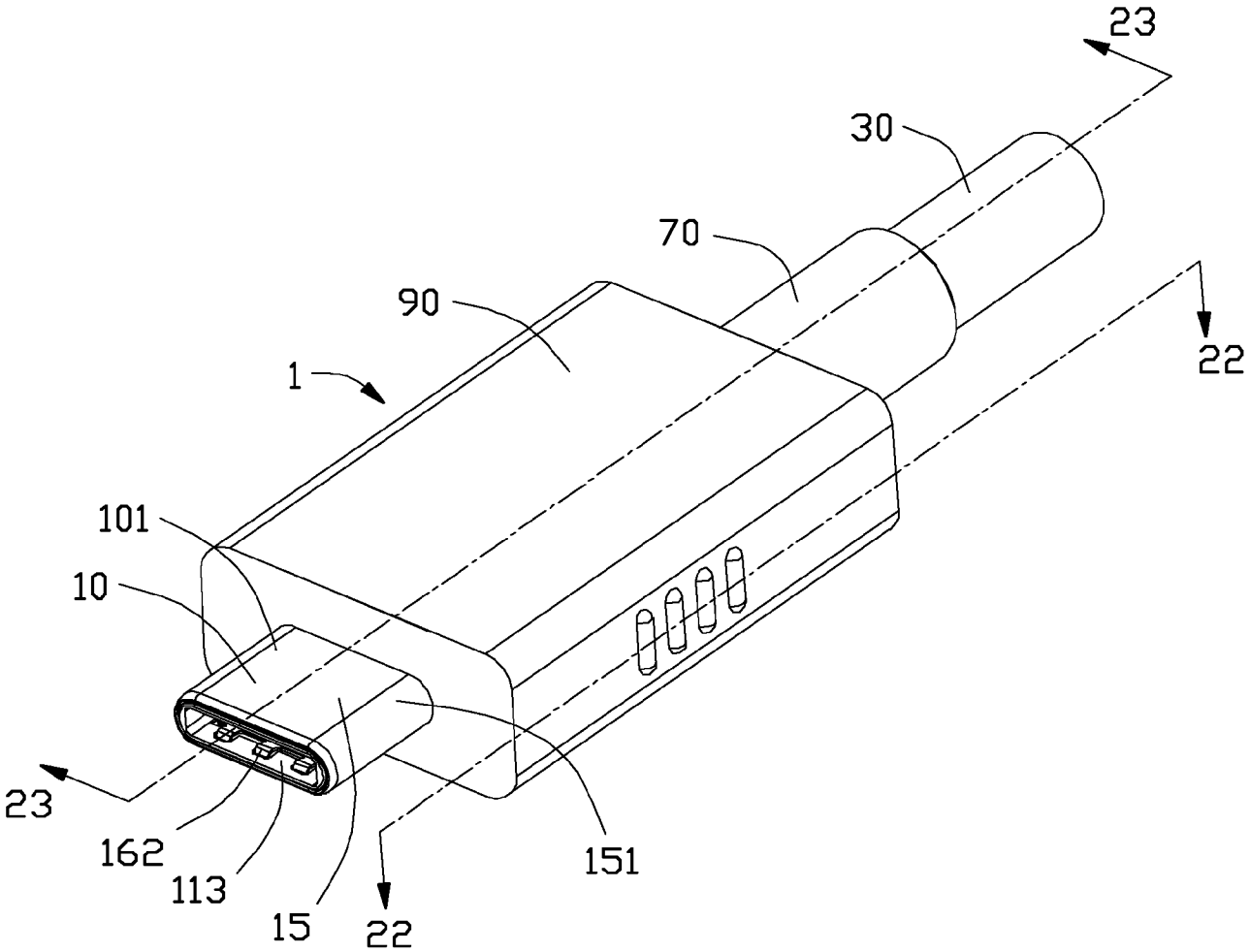
FIG. 16 is a perspective view of a plug connector assembly in accordance with a second embodiment of the present invention.
Figure 17:
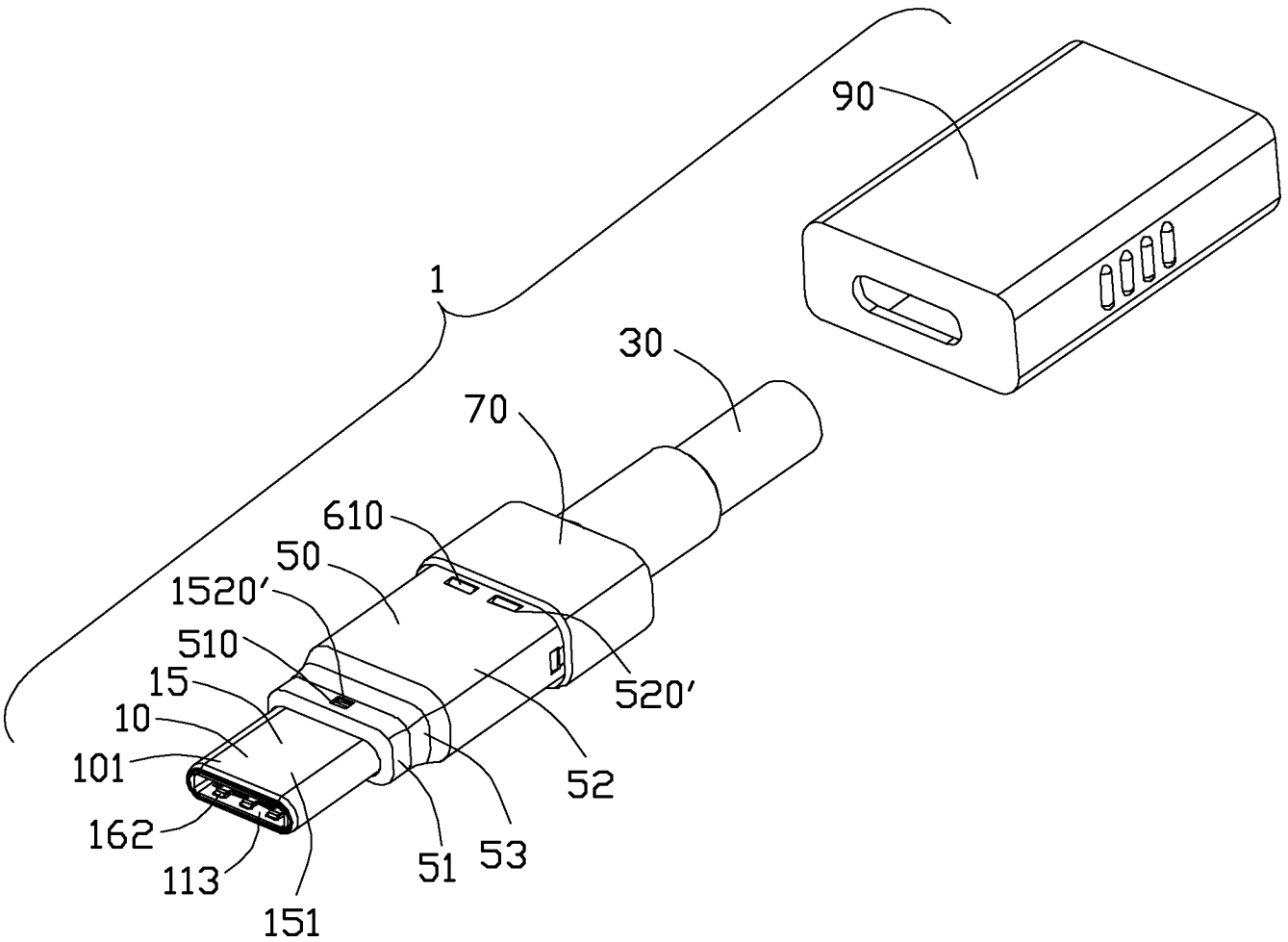
FIG. 17 is a partially exploded view of the plug connector assembly as shown in FIG. 16.
Figure 18:
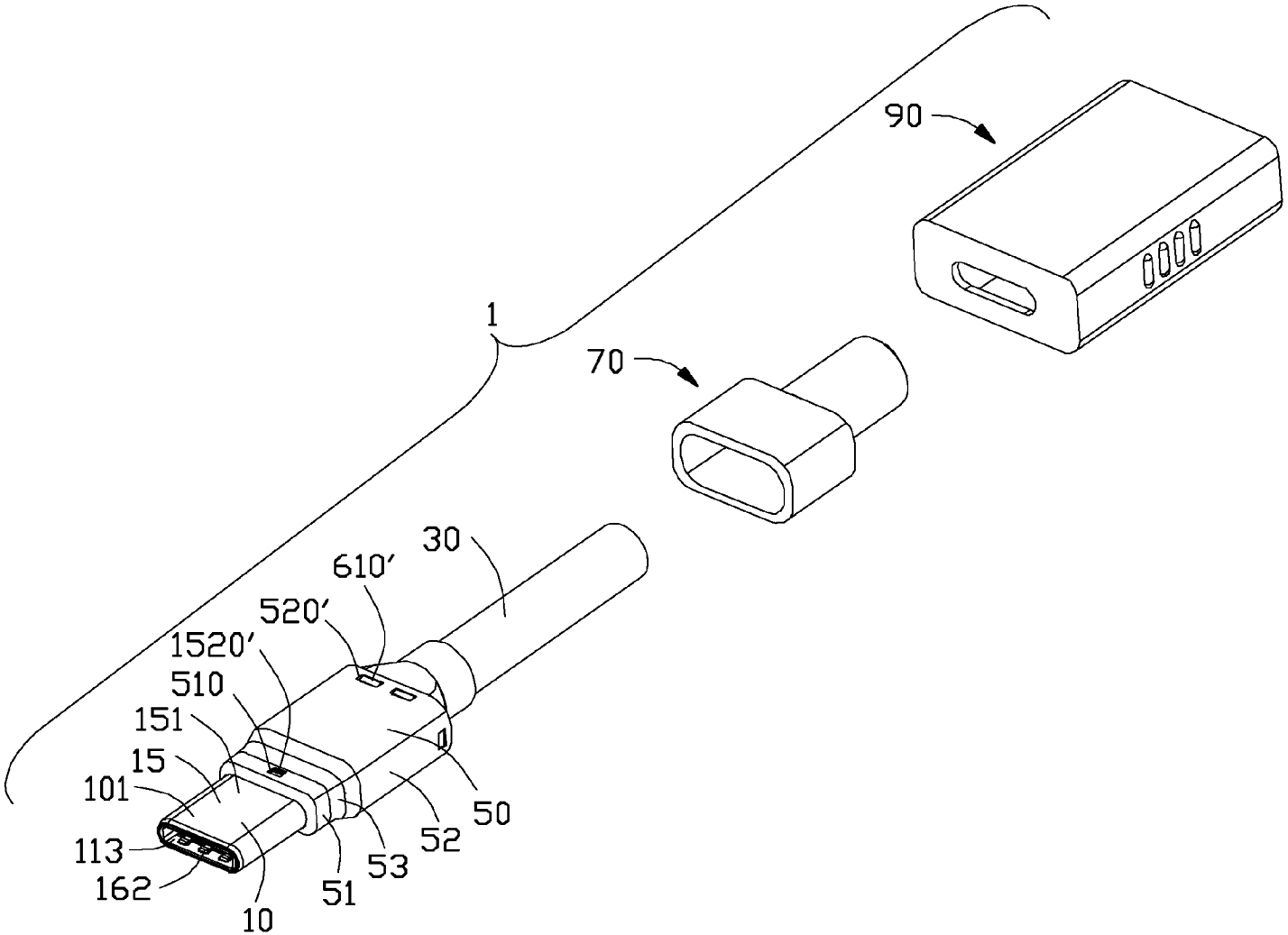
FIG. 18 is a further partially exploded view of the plug connector assembly as shown in FIG. 17.
Figure 19:
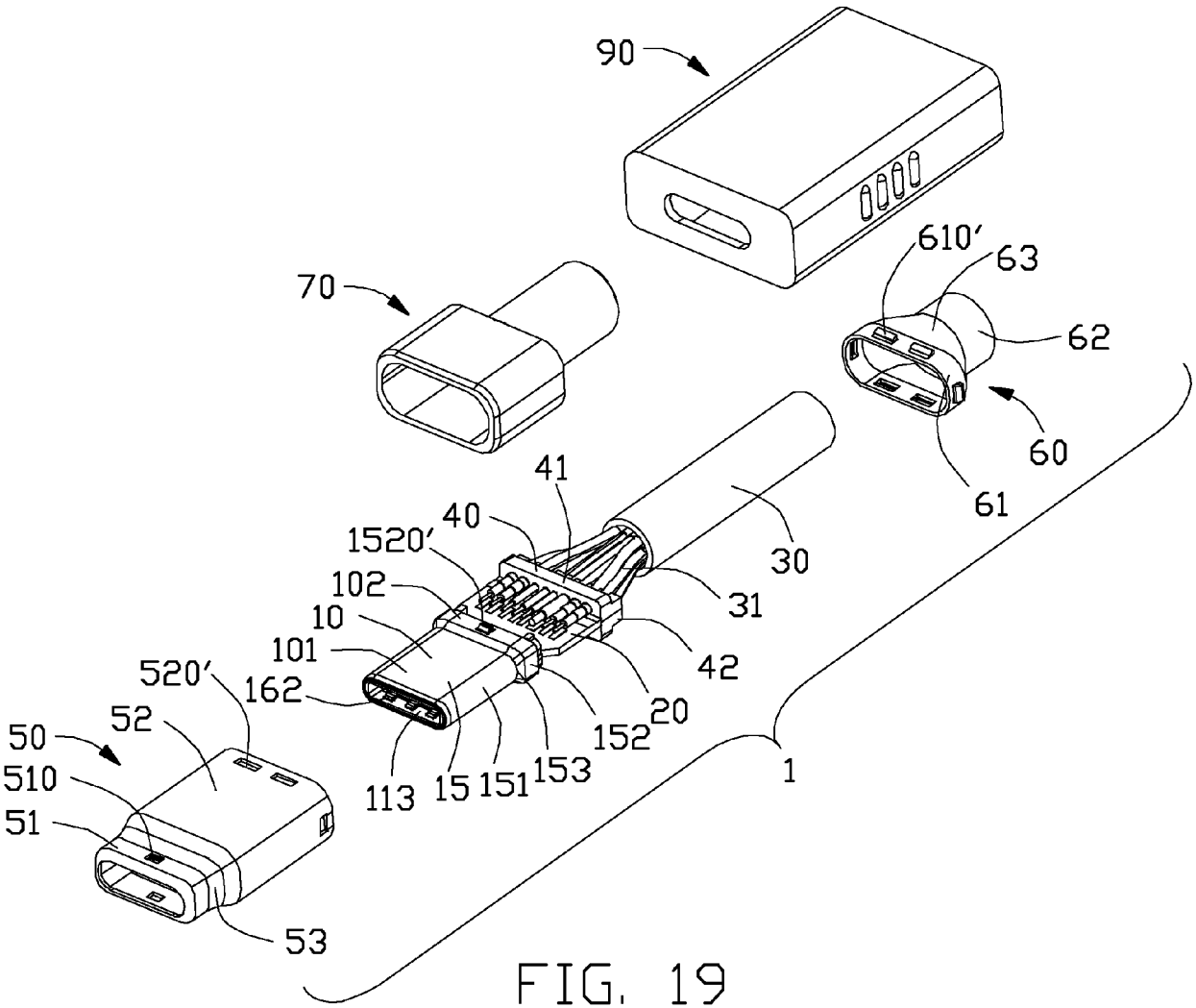
FIG. 19 is a further partially exploded view of the plug connector assembly as shown in FIG. 18.
Figure 20:
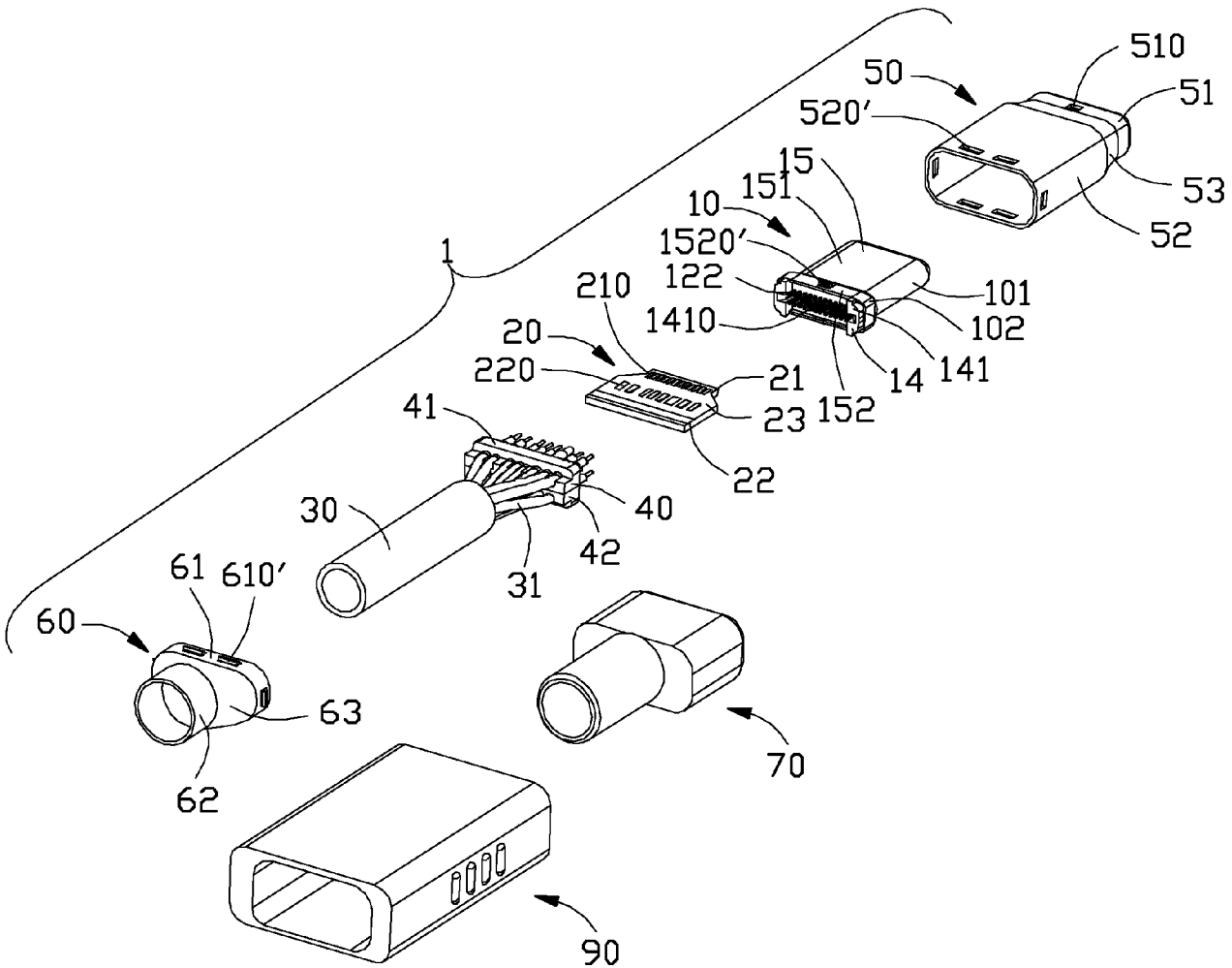
FIG. 20 is an exploded view of the plug connector assembly as shown in FIG. 16.
Figure 21:
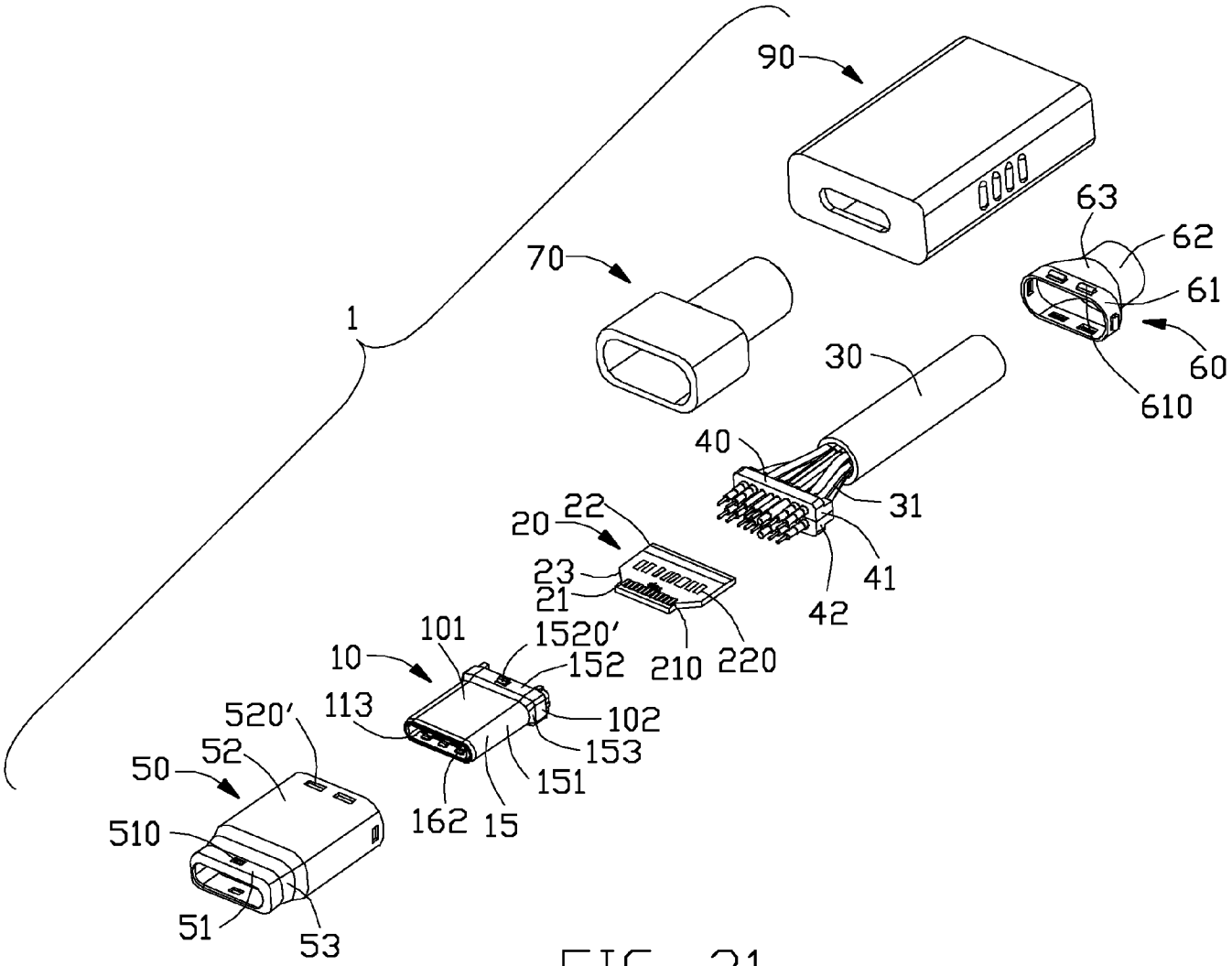
FIG. 21 is another exploded view of the plug connector assembly as shown in FIG. 20.
Figure 22:
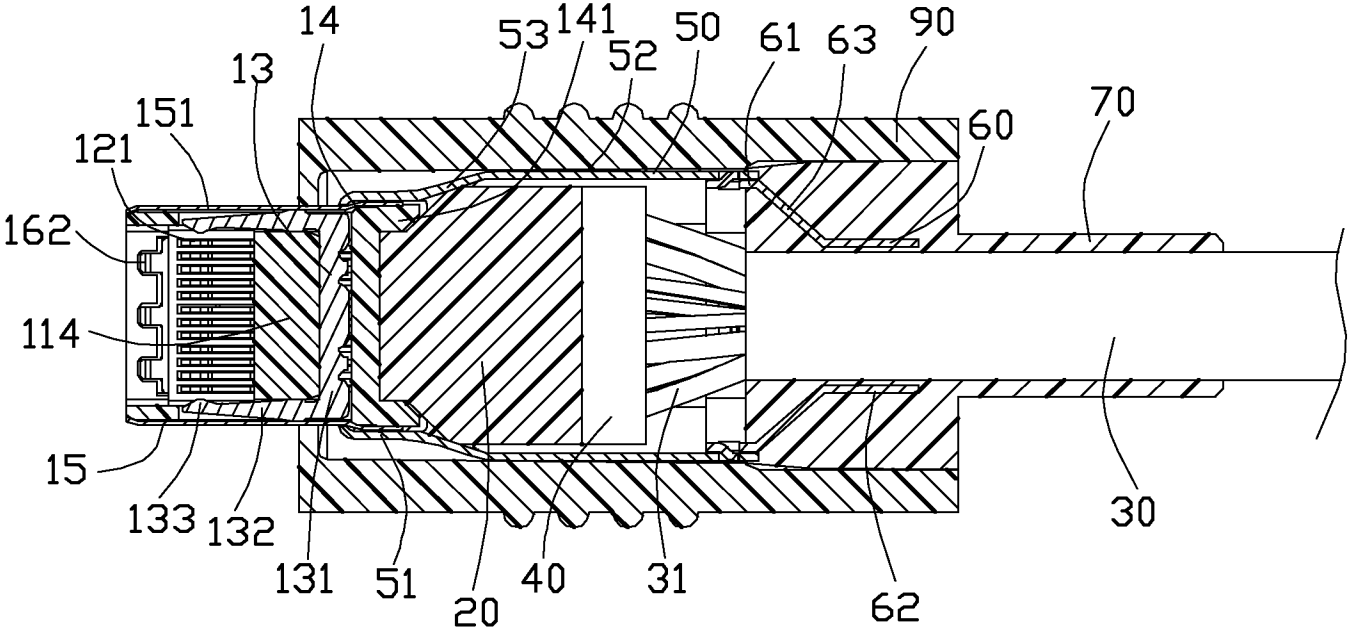
FIG. 22 is a cross-section view of the plug connector assembly taken along line XXII-XXII of FIG. 16.
Figure 23:
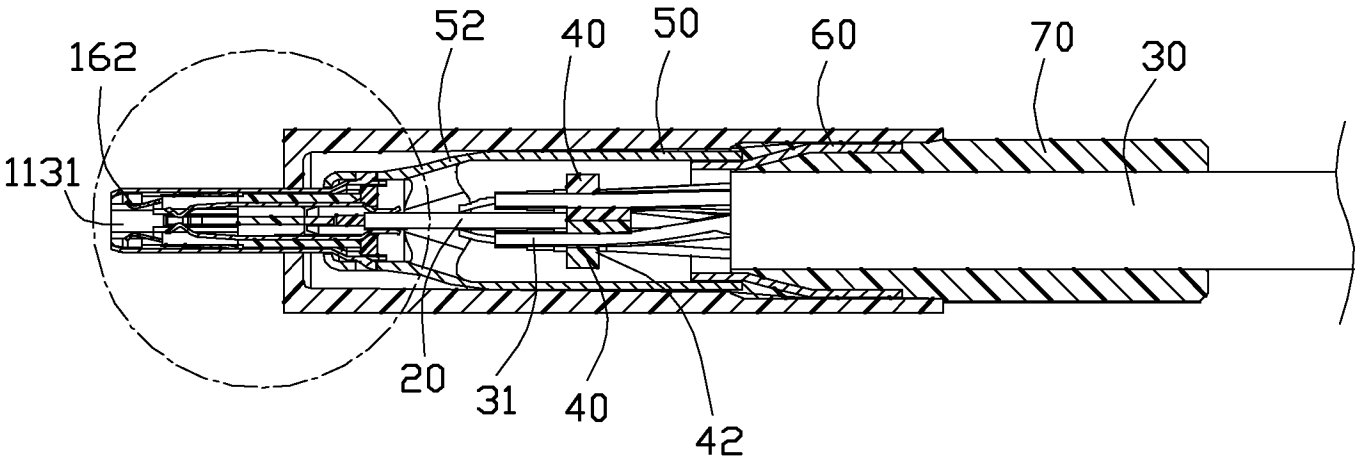
FIG. 23 is a cross-section view of the plug connector assembly taken along line XXIII-XXIII of FIG. 16.
Figure 24:
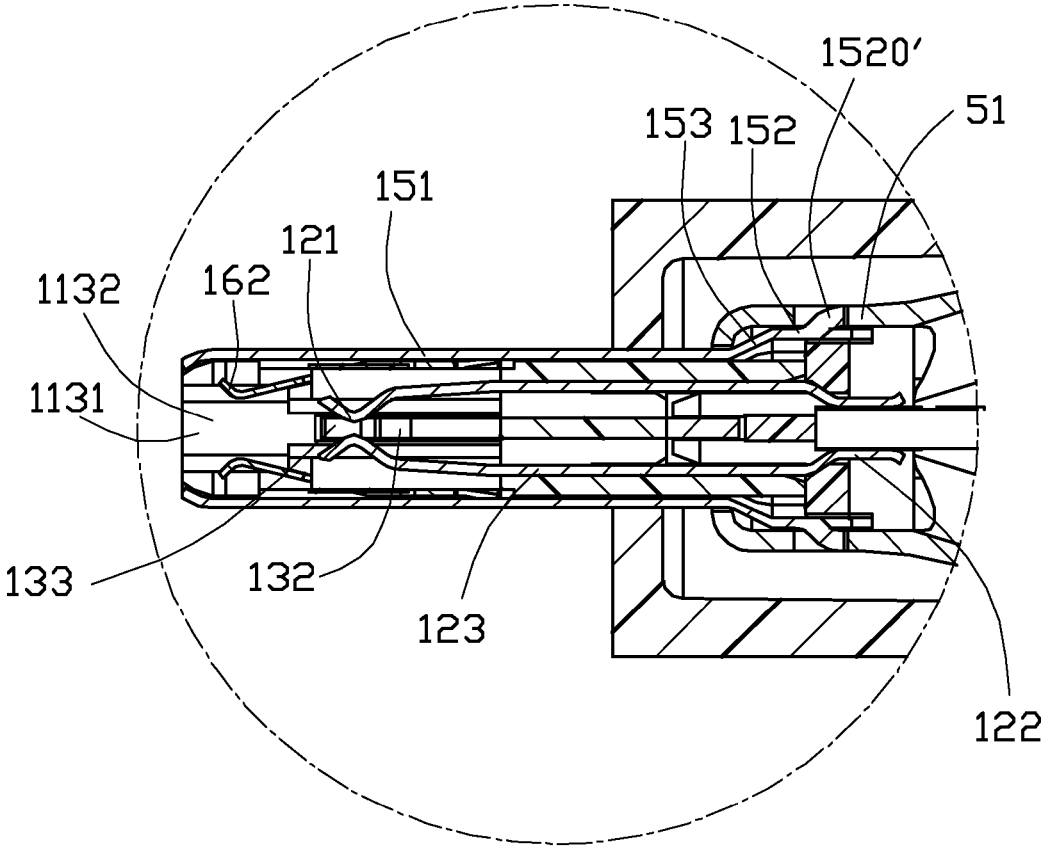
FIG. 24 is an enlarged view of circled portion as shown in FIG. 23.

Referring to FIGS. 16 to 24, an plug connector assembly 1 in accordance with a second embodiment of the present invention adapted for mating with a mating connector (Not shown), comprises mating member 10, a printed circuit board 20 disposed behind and electrically connecting with the mating member 10, a cable 30 comprising a plurality of wires 31 and electrically connected with the printed circuit board 20, a spacer 40 for restricting the wires 31, a first shell 50 having a closed circumference, a second shell 60 having a closed circumference, a strength released member 70, and an outer mold 90. The plug connector assembly can be mated with the mating connected along two opposite directions.

The mating member 10 of the second embodiment is same as the mating member 10 of the first embodiment, but the latch tabs 1520' of the third shell 15 of the second embodiment has a little difference compared with the latch tabs 1520 of the third shell 15 of the first embodiment. So, the detailed description of the mating member 10 of the second embodiment can refer the corresponding portion of the first embodiment. The printed circuit board 20 and the cable 30 of the second embodiment are fully same as the printed circuit board 20 and the cable 30 of the first embodiment, respectively. So, the detailed description of the printed circuit board 20 and the cable 30 of the second embodiment can refer the corresponding portion of the first embodiment.

Referring to FIGS. 19-23, the spacer 40 comprises a upper half portion 41 and a bottom half portion 42 mated with the upper half portion 41. The spacer is forwardly pressed against with a rear side of the printed circuit board 20. The wires 31 of the cable 30 is divided into two rows by the upper and bottom half portions 41, 42 that is facility to connect with the rear conductive pads 220 of the printed circuit board 20.

Referring to FIGS. 17-24, the first shell 50 has a closed circumference that has a good seal performance, a good anti-EMI performance etc. The closed circumference of the first shell 50 could be formed by sheet metal drawing, bend metal piece, die casting, etc. The first shell 50 comprises a first front end 51 telescoped with the rear mating end 102 of the mating member 10, a first rear end 52 opposite to the first front end 51, and a first transition portion 53 connecting with the first front end 51 and the first rear end 52. The first front end 51 is smaller than the first rear end 52. The first front end 51 defines a pair of latch holes 510 latched with the latch tabs 1520' of the third shell 15, when the first shell 50 is telescoped on an outer side of the third rear end 152 of the third shell 15. The first front end 51 of the first shell 50 is interference fitted with the third rear end 152 of the third shell 15 that has a good seal performance and good anti-EMI performance. The first front end 51 of first shell 50 and the third rear end 152 of the third shell 15 are further connected by laser beam welded in some points or full circumference that has a good strength. The first rear end 52 comprises a plurality of latch holes 520'.

The second shell 60 has a closed circumference that has a good seal performance, a good anti-EMI performance etc. The closed circumference of the second shell 60 could be formed by sheet metal drawing, bend metal piece, die casting, etc. The second shell 60 comprises a second front shell 61 telescoped with the first rear end 52 of the first shell 50, a second rear end 62 telescoped and crimped with the cable 30, and a second transition portion 63 connecting with the second front end 61 and the second rear end 62. The second front end 61 is larger than a second rear end 62. The second front end 61 defines a plurality of latch tabs 610'. The second front end 61 is telescoped into the first rear end 51, and the latch tabs 610' are latched with the latch holes 520'. The second front end 61 of the second shell 60 is interference fitted with the first rear end 52 of the first shell 50 that has a good seal performance and good anti-EMI performance. The second front end 61 of second shell 60 and the first rear end 52 of the first shell 50 are further connected by laser beam welded in some points or full circumference that has a good strength.

The strength released member 70 is molded on the second shell 60 and the cable 30 to reduce the strength, when the cable 30 is bent. The outer mold 90 can be molded or mounted on the strength released member 70.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector assembly adapted for mating with a mating connector, comprising:

a mating member comprising a front mating end for being inserted into the mating connector, and a rear mating end opposite to the front mating end;

a cable electrically connected with the mating member;

a first shell formed by sheet metal drawing, the first shell having a closed circumference, the first shell comprising a first front end telescoped with the rear mating end, and a first rear end opposite to the first front end; and a second shell formed by sheet metal drawing, the second shell having a closed circumference, the second shell comprising a second front end telescoped with the first rear end, and a second rear end opposite to the second front end and telescoped on the cable;

wherein the mating member comprises an insulative housing, a plurality of first contacts arranged in two rows and spaced apart from each other in a vertical direction, and a latch disposed between the two rows of contacts for latching with the mating connector.

2. The plug connector assembly as recited in claim 1, wherein the mating member comprises an insulative member disposed behind the insulative housing, the insulative member restricting the latch to cooperate with the insulative housing.

3. The plug connector assembly as recited in claim 1, further comprising a printed circuit board disposed between the mating member and the cable for electrically connecting the cable and the mating member.

4. The plug connector assembly as recited in claim 1, wherein the first front end has a diameter smaller than a diameter of the first rear end, the first shell comprising a first transition portion connecting with the first front end and the first rear end.

5. The plug connector assembly as recited in claim 4, wherein the second front end has a diameter larger than a diameter of the second rear end, the second shell comprising a second transition portion connecting with the second front end and the second rear end.

6. The plug connector assembly as recited in claim 1, wherein the second front end is laser beam welded to the first rear end.

7. The plug connector assembly as recited in claim 1, wherein one of the first rear end and the second front end comprises a latch tab, and the other one of the first rear end and the second front end comprises a latch hole latched with the latch tab.

8. A plug connector assembly adapted for mating with a mating connector, comprising:

a mating member comprising a front mating end for being inserted into the mating connector, and a rear mating end opposite to the front mating end;

a cable electrically connected with the mating member;

a spacer comprising a first portion and a second portion disposed behind the first portion, the second portion having a diameter larger than a diameter of the first portion;

a first shell having a closed circumference, the first shell comprising a first front end telescoped with the rear mating end, and a first rear end opposite to the first front end; and a second shell having a closed circumference, the second shell comprising a second front end telescoped with the first rear end, and a second rear end opposite to the second front end and telescoped on the cable;

wherein the first rear end is telescoped on the first portion of the spacer, and the second front end is slid over the second and telescoped on an outer side of the first rear end.

9. The plug connector assembly as recited in claim 8, wherein a gap exists between the second portion and the first portion of the spacer and is larger than or equal to a thickness of the circumference of the first shell.

10. The plug connector assembly as recited in claim 8, wherein the second front end interference fits with an outer side of the first rear side.

11. The plug connector assembly as recited in claim 8, wherein the second front end is laser beam welded with the first rear end.

12. The plug connector assembly as recited in claim 8, wherein the cable comprises a plurality of wires organized by the spacer.

13. The plug connector assembly as recited in claim 12, wherein the spacer comprises an upper portion and a lower portion each defining a plurality of through holes, the wires received in and restricted by the through holes.

14. The plug connector assembly as recited in claim 8, wherein the mating member comprises a third shell having a closed circumference, the first front end laser beam welded with the third shell.

15. A cable connector assembly comprising:

a mating member extending along a front-to-back direction and including an insulative housing enclosed within a capsular metallic front shell which is essentially configured as a tubular structure via a drawing process in a seamless manner thereof;

a plurality of terminals disposed in the housing with corresponding contacting sections exposed to a receiving room in the housing;

a printed circuit board located behind the housing, along said front-to-back direction, with tails of said terminals mounted upon a front region thereof;

a metallic middle shell located behind the front shell along said front-to-back direction and surrounding the printed circuit board, said middle shell being essentially configured as another tubular structure via another drawing process in the seamless manner; wherein the front shell includes a rear connection end and the middle shell includes a front connection end snugly circumferentially connected to the rear connection end, and one of said rear connection end and said front connection end includes a latch to be engaged with the other so as to retain the front shell and the middle shell with each other without relative movement in said front-to-back direction; and a cable enclosing a plurality of wires connected to a rear region of the printed circuit board, and a metallic rear shell located behind the middle shell to enclose said cable, wherein said rear shell is essentially configured as another tubular structure via another drawing process in the seamless manner, a front connection end of the rear shell is snugly circumferentially connected to a rear connection end of the middle shell.

16. The cable connector assembly as claimed in claim 15, wherein all said front shell, said middle shell and said rear shell are linked with one another in sequence along said front-to-back direction in roughly a telescopic manner.

17. The cable connector assembly as claimed in claim 15, wherein in the middle shell, the front connection end is smaller than the rear connection end.

18. The cable connector assembly as claimed in claim 17, wherein the front connection end of the middle shell is located outside of the rear connection end of the front shell, and the rear connection end of the middle shell is located outside of the front connection end of the rear shell.

* * * * *